US006267031B1

(12) United States Patent
Cheng

(10) Patent No.: US 6,267,031 B1
(45) Date of Patent: Jul. 31, 2001

(54) TOOL FOR ENGAGING SOCKETS

(76) Inventor: Yen-Shuang Cheng, No. 1-3, Alley 33, Lane 1, Lin sen St., Ban-Chiau City, Taipei Hsien (TW)

( * ) Notice: Subject to any disclaimer, the term of this patent is extended or adjusted under 35 U.S.C. 154(b) by 0 days.

(21) Appl. No.: 09/484,233

(22) Filed: Jan. 18, 2000

(51) Int. Cl.[7] ..... B25B 23/16
(52) U.S. Cl. ..... 81/177.2; 81/177.1; 81/177.7
(58) Field of Search ..... 81/177.2, 177.1, 81/177.7

(56) References Cited

U.S. PATENT DOCUMENTS 3,424,212 * 1/1969 Kemper .
5,690,006 * 11/1997 Pulliam .
6,058,813 * 5/2000 Bryant et al. .

* cited by examiner

*Primary Examiner*—Willie Berry, Jr.
(74) *Attorney, Agent, or Firm*—Rosenberg, Klein & Lee

(57) ABSTRACT

A tool for engaging sockets includes a shank with a handle one end of the shank and a slot defined longitudinally in an outside of the other end of the shank. An engaging member is slidably received in the slot and a spring mounted to the shank urges a first protrusion of the engaging member. A sleeve is movably mounted to the shank and a shoulder portion extends inward from an inside of the sleeve. The first protrusion is urged by the spring and engaged with the shoulder portion. When sliding the sleeve, a second protrusion of the engaging member is controlled to extend from the slot so as to engage with a socket.

5 Claims, 6 Drawing Sheets

TOOL FOR ENGAGING SOCKETS

FIELD OF THE INVENTION

The present invention relates to a socket tool, and more particularly, to a tool that includes a sleeve for controlling an engaging member received in a slot in the shank of the tool. The movement of the sleeve decides the position of the engaging member so that a socket can be secured by the engaging member.

BACKGROUND OF THE INVENTION

A conventional socket tool is shown in FIG. 6 and generally includes a shank 90 having a rectangular end on one end of the shank 90 and a bar 900 is connected to the other end of the shank 90. The rectangular end has a ball 92 embedded in a side thereof so that when a socket 91 is mounted to the rectangular end, the ball 92 urges against an inside of the socket 91 so that the socket 91 is positioned on the rectangular end. The ball 92 is biased by a spring which is received in a recess in the side of the rectangular end. It is difficult to remove the socket 91 from the rectangular end if the spring force so large that the user will take a great effort to overcome the engaging force between the ball 92 and the socket 91. On the contrary, if the spring force is small, the socket 91 could drop easily.

The present invention intends to provide a tool having a sleeve that controls an engaging member so that the engaging member can be received in a slot by operating the sleeve when the socket is to be mounted to or removed from the tool.

SUMMARY OF THE INVENTION

In accordance with one aspect of the present invention, there is provided a tool for engaging sockets, comprising a shank and a handle connected to one end of the shank. A slot is defined longitudinally in an outside of the other end of the shank so that an engaging member is slidably received in the slot. The engaging member has a first protrusion and a second protrusion which is to be engaged with a socket. A sleeve is movably mounted to the shank and a shoulder portion extends inward from an inside of the sleeve. A spring is mounted to the shank. The first protrusion is urged by the spring and engaged with the shoulder portion of the sleeve.

The object of the present invention is to provide tool for engaging sockets and a sleeve is mounted to the shank so as to control an engaging member that is movably engaged with sockets.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
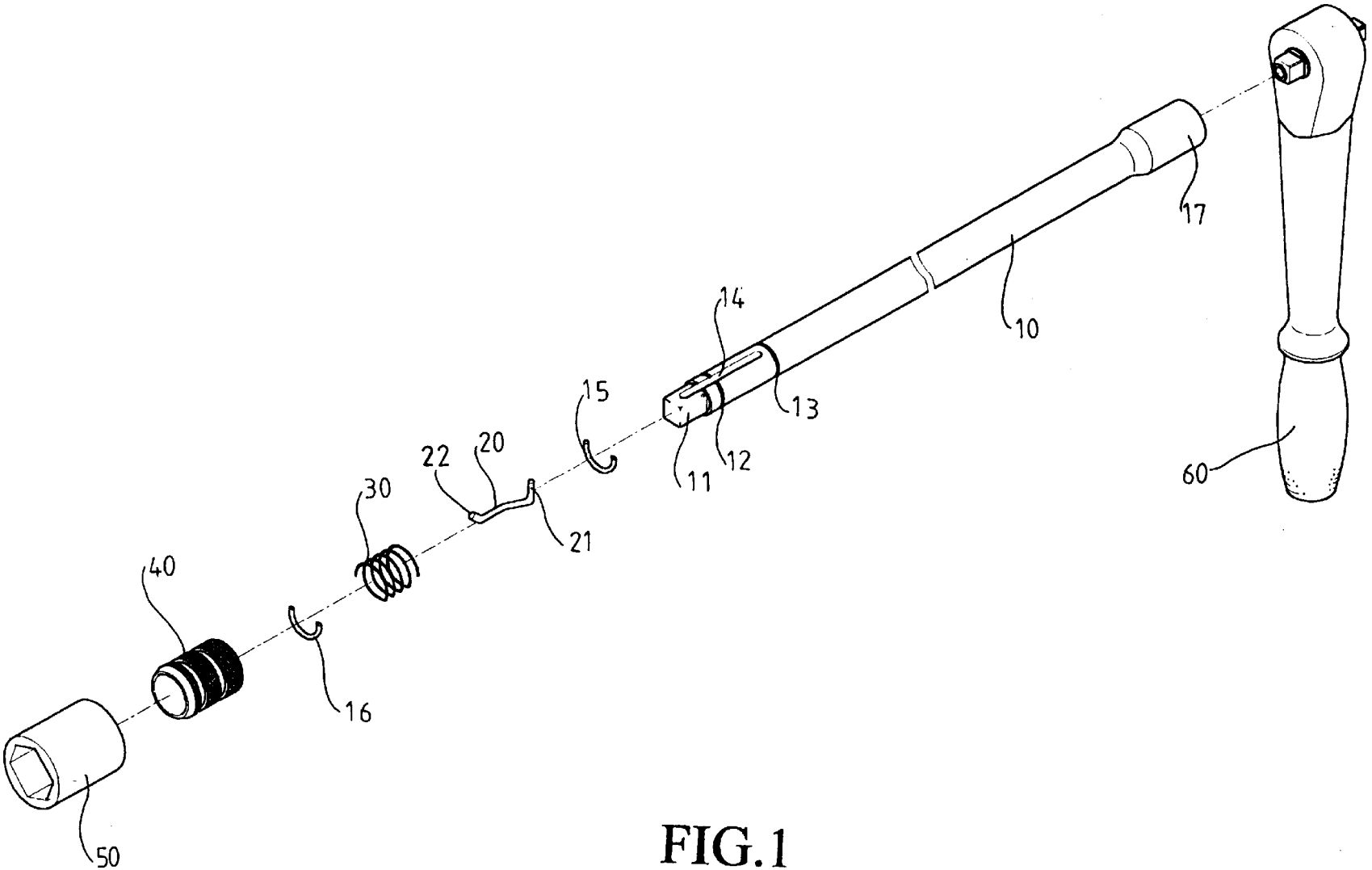
FIG. 1 is an exploded view to show the tool of the present invention.
Figure 2:
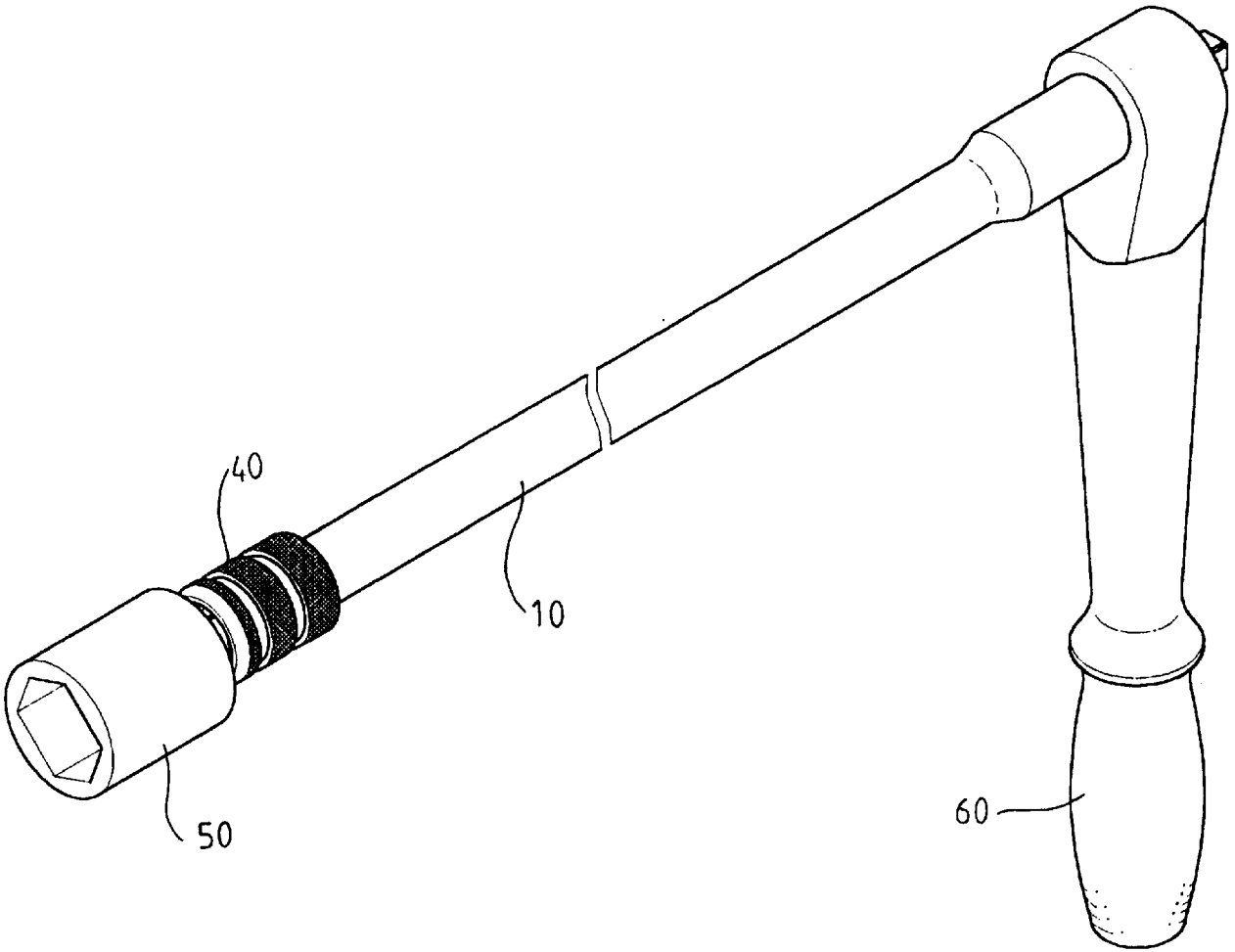
FIG. 2 is a perspective view to show the tool of the present invention.
Figure 3:
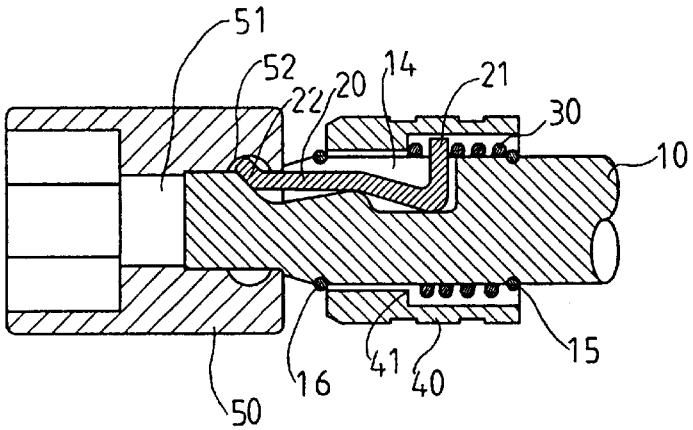
FIG. 3 is a side elevational view, partly in section, of the tool that a socket is engaged with an engaging member in the slot of the tool.

Referring to FIGS. 1 to 3, the tool in accordance with the present invention comprises a shank 10 and a handle 60 which is perpendicularly connected to one end 17 of the shank 10. A slot 14 is defined longitudinally in an outside ofthe other end 11 of the shank 10. The said other end 11 is a rectangular end for a socket 50 to be engaged therewith. Two grooves 12 and 13 are defined in the shank 10 so that two stops such as two C-shaped clamping members 15 and 16 are respectively engaged with the two grooves 12 and 13.

An engaging member 14 is slidably received in the slot 14. The engaging member 14 has a first protrusion 21 and a second protrusion 22. The first protrusion 21 and the second protrusion 22 respectively extend from the slot 14. A spring 30 is mounted to the shank 10 and one end of the spring 30 is stopped by the C-shaped clamping member 15.

A sleeve 40 is movably mounted to the shank 10 and a shoulder portion 41 extends inward from an inside of the sleeve 40. The first protrusion 21 of the engaging member 14 is urged by the spring 30. Both of the first protrusion 21 of the engaging member 14 and the other end of the spring 30 are engaged with the shoulder portion 41 of the sleeve 40.

The socket 50 has a rectangular passage 51 so as to be mounted to the rectangular end 11 of the shank 10. An annular groove 52 is defined in an inside of one end of the socket 50 and the second protrusion 22 is engaged with the annular groove 52 of the socket 50 to securely position the socket 50 to the rectangular end 11. Because the engaging member 14 is urged by the spring 30 so that the second protrusion 22 of the engaging member 14 can be securely engaged with the annular groove 52.

Figure 4:
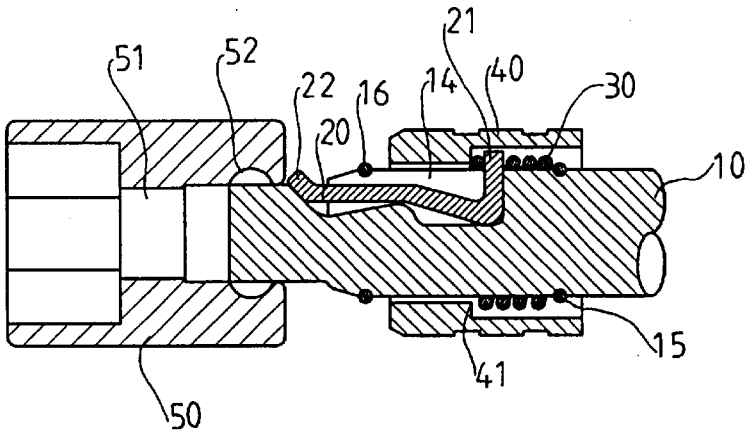
FIG. 4 is a side elevational view, partly in section, of the tool that a socket is disengaged from the engaging member when the sleeve is pulled.

As shown in FIG. 4, when pulling the sleeve 40 to let the shoulder portion 41 compress the spring 30 and push the engaging member 14, the movement of the engaging member 14 makes the second protrusion 22 be lowered into the slot 14 so that the socket 50 can be easily removed from the rectangular end 11 or mounted to the rectangular end 11.

Figure 5:
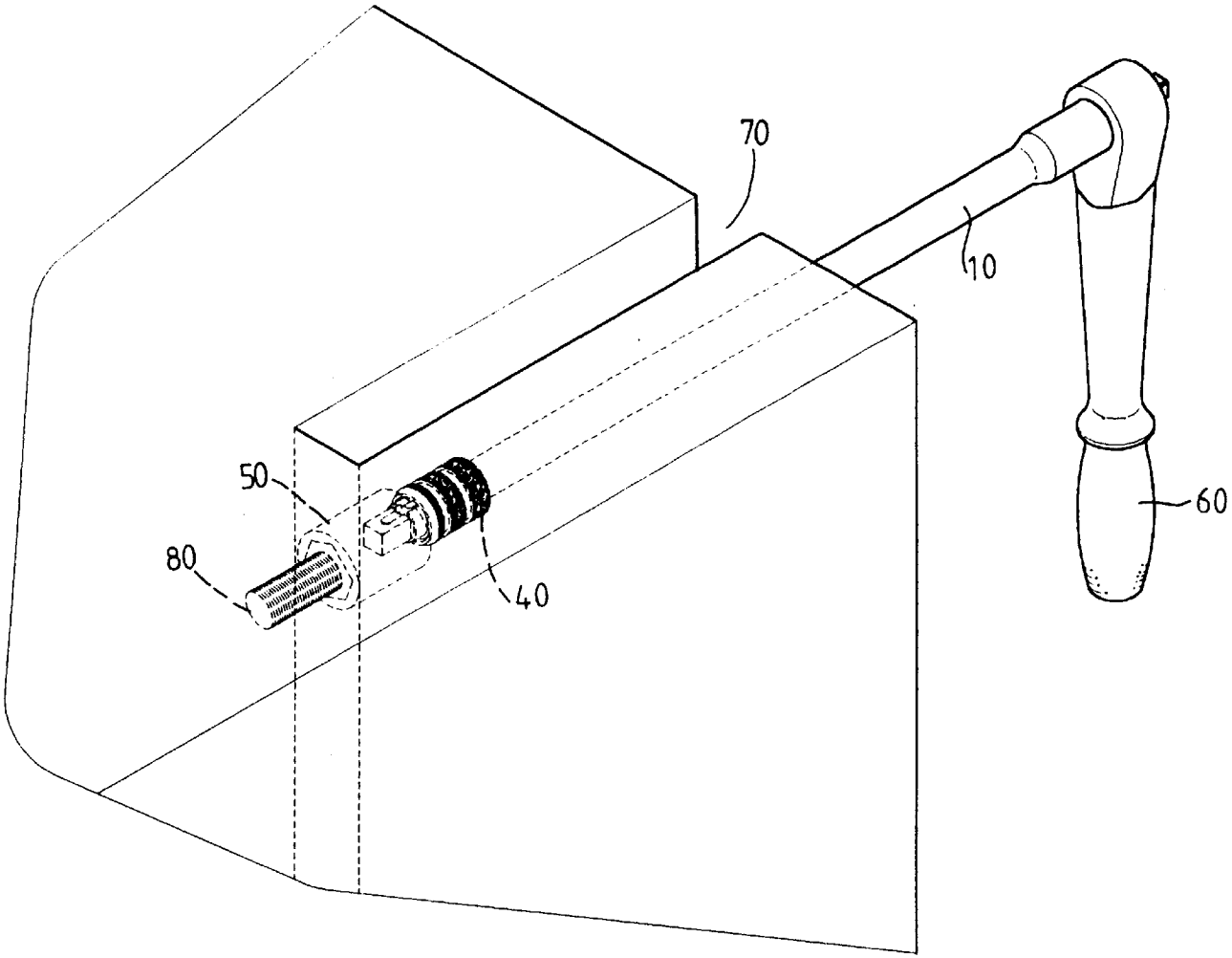
FIG. 5 is an illustrative view to show the shank of the tool extends into a narrow space.
Figure 6:
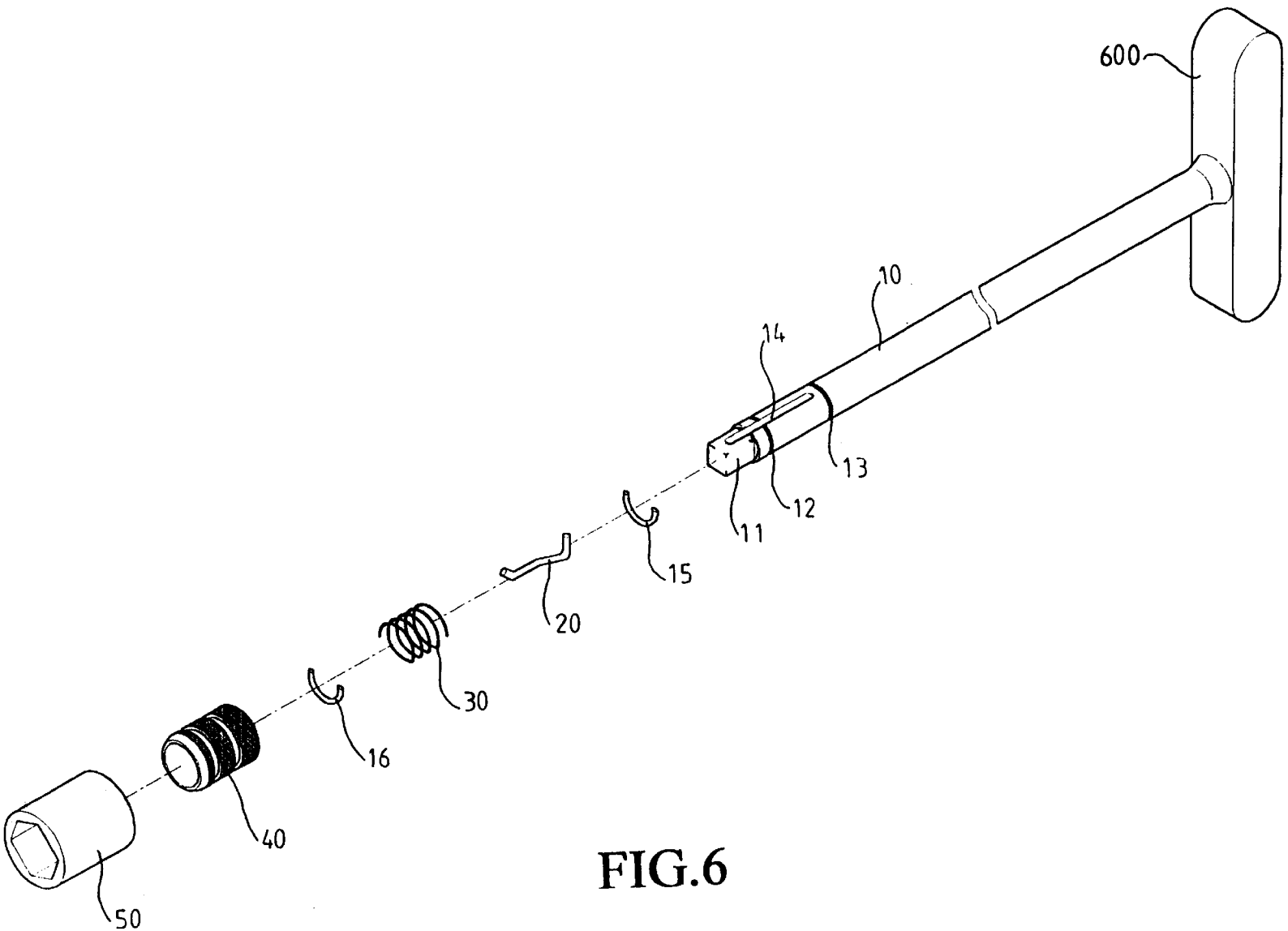
FIG. 6 is an exploded view to show that the tool has a T-shaped handle.
Figure 7:
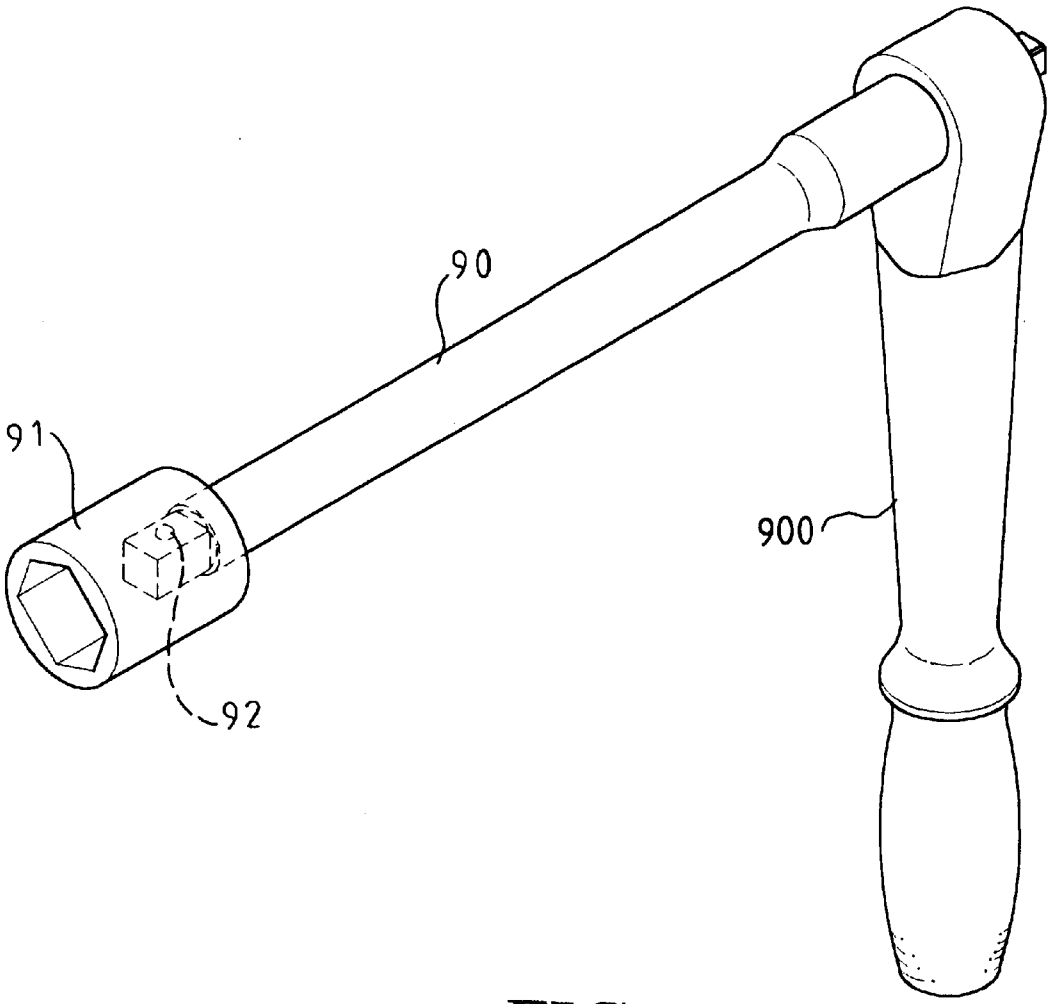
FIG.7 PRIOR ART
FIG. 7 is a perspective view to show a conventional tool for engaging sockets.

As shown in FIG. 5, the shank 10 can be easily inserted into a narrow space 70 to let the socket 50 engage with an object 80. FIG. 6 shows that the tool may have a T-shaped handle 600.

It is to be understood that various type of tools such as universal joints, rectangular rods, extension rods, wrenches with a H-shaped handle, wrenches with a round handle or flex ratchet.

While we have shown and described various embodiments in accordance with the present invention, it should be clear to those skilled in the art that further embodiments may be made without departing from the scope and spirit of the present invention.

What is claimed is:

1. A tool for engaging sockets, comprising:

a handle;

a longitudinally extended shank having a first end coupled to said handle and an opposing second end having a polygonal shape for receiving a socket thereon, said shank having a longitudinally extended slotted opening formed therein, said slotted opening having at least a portion thereof disposed in said polygonal second end, said shank having a first stop longitudinally spaced from said second end;

an engaging member disposed in said slotted opening and slidably displaceable from a first position to a second position, said engaging member having a first protrusion and a second protrusion formed on ends thereof and each extending from said slotted opening, said second protrusion being disposed at said second end of said shank responsive to said engaging member being in said first position for engaging a recess of the socket received on said shank to secure the socket against longitudinal displacement, said second protrusion being displaced from said second end of said shank responsive to said engaging member being in said second position to release the socket for longitudinal displacement from said second end of said shank;

a sleeve slidably disposed on said shank adjacent said second end, said sleeve having an inwardly extending shoulder contacting said first protrusion of said engaging member, said engaging member being slidably displaced responsive to sliding displacement of said sleeve; and, a spring disposed between said first stop and said first protrusion for biasing said engaging member toward said first position.

2. The tool as recited in claim 1, wherein said first stop includes a C-shaped clamping member coupled to said shank.

3. The tool as recited in claim 1, wherein said shank includes a second stop located between said second end and said sleeve.

4. The tool as recited in claim 3, wherein said second stop includes a C-shaped clamping member coupled to said shank.

5. The tool as recited in claim 1, wherein said handle extends substantially orthogonally with respect to said shank.

* * * * *